US010022734B2

(12) United States Patent
Fabrizio

(10) Patent No.: US 10,022,734 B2
(45) Date of Patent: Jul. 17, 2018

(54) VARIABLE DUAL FLOW FITTING

(71) Applicant: Chronomite Laboratories, Inc., City of Industry, CA (US)

(72) Inventor: Edward Vincent Fabrizio, Rancho Cucamonga, CA (US)

(73) Assignee: CHRONOMITE LABORATORIES, INC., City of Industry, CA (US)

( * ) Notice: Subject to any disclaimer, the term of this patent is extended or adjusted under 35 U.S.C. 154(b) by 0 days.

(21) Appl. No.: 15/350,794

(22) Filed: Nov. 14, 2016

(65) Prior Publication Data

US 2018/0133724 A1 May 17, 2018

(51) Int. Cl.

| | |
|---|---|
| ***B05B 1/18*** | (2006.01) |
| ***B05B 1/30*** | (2006.01) |
| ***B05B 1/32*** | (2006.01) |
| ***E03C 1/04*** | (2006.01) |
| *E03C 1/02* | (2006.01) |

(52) U.S. Cl.

CPC ..... *B05B 1/185* (2013.01); *B05B 1/3086* (2013.01); *B05B 1/32* (2013.01); *E03C 1/0408* (2013.01); *E03C 2001/026* (2013.01)

(58) Field of Classification Search

CPC ..... B05B 1/1636; B05B 1/18; B05B 1/185; B05B 1/3026; B05B 1/3033; B05B 1/3086; B05B 1/32; E03C 1/0408; E03C 2001/026

See application file for complete search history.

(56) References Cited

U.S. PATENT DOCUMENTS

| | | | | |
|---|---|---|---|---|
| 2,949,242 A * | 8/1960 | Blumberg | ..... | B05B 1/3086 239/451 |
| 3,254,842 A * | 6/1966 | Bachli | ..... | B05B 1/3086 239/107 |
| 3,344,994 A * | 10/1967 | Fife | ..... | B05B 1/3086 239/107 |
| 3,383,051 A * | 5/1968 | Fiorentino | ..... | B05B 1/3086 239/107 |

(Continued)

FOREIGN PATENT DOCUMENTS

WO 99058775 11/1999

OTHER PUBLICATIONS

Omni Brochure, www.omniflowcontrols.com, Faucet Flow Controls and Showerheads, a Division of Chronomite Laboratories.

*Primary Examiner* — Darren W Gorman

(74) *Attorney, Agent, or Firm* — Eric J. Sosenko; Jonathan P. O'Brien; Honigman Miller Schwartz and Cohn LLP

(57) ABSTRACT

The present disclosure relates to a dual flow fitting that permits a user to select between a first, low flow rate and a second, high flow rate, as well as variable flow rates there between. The fitting includes a plunger within a housing body. A plurality of longitudinal grooves are defined along either the inside of the housing body or the outside of the plunger. At least one of the grooves has a varying portion along which the cross-sectional area of the groove varies over a length of the groove. This varying portion can be moved relative to a seal member positioned between the housing body and the plunger, thus allowing for variation of the flow rate through the fitting. The larger the cross-sectional area of the groove(s) at the point of contact with the seal member, the greater the flow rate through the fitting.

15 Claims, 6 Drawing Sheets

(56) References Cited

U.S. PATENT DOCUMENTS

| | | | | | |
|---|---|---|---|---|---|
| 3,384,307 | A * | 5/1968 | Moen | B05B 1/3086 | 239/107 |
| 3,403,860 | A * | 10/1968 | Shames | B05B 1/3086 | 239/460 |
| 3,617,002 | A * | 11/1971 | Symmons | B05B 1/3086 | 239/460 |
| 4,324,364 | A * | 4/1982 | Buzzi | B05B 1/1627 | 239/381 |
| 4,330,089 | A * | 5/1982 | Finkbeiner | B05B 1/1681 | 239/381 |
| 4,344,459 | A | 8/1982 | Nelson | | |
| 4,346,844 | A * | 8/1982 | Harmony | B05B 1/1636 | 239/381 |
| 4,427,155 | A * | 1/1984 | Larsson | B05B 1/16 | 239/460 |
| 5,348,231 | A | 9/1994 | Arnold et al. | | |
| 6,234,192 | B1 | 5/2001 | Esche et al. | | |
| 7,431,224 | B2 | 10/2008 | Laker | | |
| 7,581,685 | B2 | 9/2009 | Belisle | | |
| 2012/0217321 | A1 * | 8/2012 | Lin | B05B 1/1636 | 239/436 |

* cited by examiner

VARIABLE DUAL FLOW FITTING

BACKGROUND

Field of the Invention

The present invention generally relates to a fitting for water supply installations. More specifically, the invention relates to a plumbing fitting, such as a showerhead or spray head, that connects to a shower arm or spout permits a user to select between a different flow rates of water.

Description of Related Art

Plumbing fittings, such as showerheads and spray heads, are used to reduce operating costs by saving water. Some fittings include other components, such as aerators that cause fine bubbles of air to be entrained in the stream of water and pressure compensators that maintain a consistent flow rate of water irrespective of the water pressure. In conjunction with the above, the fitting may also include components that control the spray pattern or the flow rate. They may also prevent splashing, reduce noise and increase the perceived water pressure.

In view of the above, it is seen that there is a need for an improved fitting that permits a user to select between a wide variety of possible flow rates.

SUMMARY

In satisfying the above need, as well as overcoming the enumerated drawbacks and other limitations of the related art, the present invention provides, in one aspect, a plumbing fitting that permits a user to select between a first or low flow rate and a second or high flow rate of water, as well as having variability in the high flow rate. The fitting, which may be a showerhead, includes a plunger within a housing body. A plurality of longitudinal (axial) grooves are defined along either outside surface of the plunger or the inside surface of the housing body. At least one of the grooves has a portion along which the cross-sectional area, and therefore the volume, of the groove varies over a length of the groove. This varying volume portion can be moved relative to a seal member, positioned between the housing body and the plunger, thus allowing for variation of the flow rate of water through the fitting. The larger the cross-sectional area of the groove(s) adjacent to the seal member, the greater the flow rate through the fitting.

In one aspect of the invention, a dual flow fitting is provided for controlling the amount of liquid being discharged through the fitting from a spout, the fitting comprising: a housing body; a plunger movably received within the housing body and being axially movably between a first flow position, a second flow position and a plurality of varied intermediate flow positions between the first and second flow positions; a first liquid passageway defined through the plunger; a second liquid passageway defined between the plunger and the housing body; the first and second liquid passageways cooperating to define a composite liquid passageway; in the first flow position, a portion of the plunger being sealingly engaged with a portion of housing body and closing off the second liquid passageway, whereby a first composite volumetric flow rate of liquid through the composite liquid passageway is defined by a first volumetric flow rate of liquid through the first liquid passageway; in the second flow position, the portion of the plunger being sealingly disengaged with the portion of housing body and the second liquid passageway being fully open, whereby a second composite volumetric flow rate of liquid through the composite liquid passageway is defined by the first volumetric flow rate of liquid through the first liquid passageway plus a second volumetric flow rate of liquid through the second liquid passageway; and in the plurality of varied intermediate flow positions, the portion of the plunger cooperates with the portion of the housing to define a corresponding plurality of varied intermediate flow restrictions in the second liquid passageway respectively defining a plurality of varied volumetric flow rates, whereby a plurality of varied composite volumetric flow rates of liquid through the composite liquid passageway are respectively defined by the first volumetric flow rate of liquid through the first liquid passageway plus one of the plurality of varied volumetric flow rates through the plurality of varied intermediate flow restrictions in the second liquid passageway.

In another aspect, a seal member supported on one of an inner radial surface of the housing body and an outer radial surface of the plunger, the outer radial surface opposing the inner radial surface.

In a further aspect, the seal member is supported on the inner radial surface and wherein position of the seal member relative to the plunger defining the first flow position, the second flow position and the varied intermediate flow positions.

In an additional aspect, the portion of the plunger includes an outer radial surface and the portion of the housing body includes an inner radial surface, and wherein one of the outer radial surface and the inner radial surface includes a constant diameter portion adjacent to a varied diameter portion.

In yet another aspect, the other of the outer radial surface and the inner radial surface includes a seal member supported there on and configured to engage the one of the outer radial surface and the inner radial surface in a region of the varied diameter portion, and wherein positions of the seal member relative to the constant and varied diameter portions defining the first flow position, the second flow position and the varied intermediate flow positions.

In still a further aspect, the portion of the plunger includes an outer radial surface and the portion of the housing body includes an inner radial surface, a plurality of grooves being defined in one of the outer radial surface and the inner radial surface and a seal member being supported by the other of the outer radial surface and the inner radial surface, the seal member and configured to engage the one of the outer radial surface and the inner radial surface in a region of the grooves.

In an additional aspect, at least one of the plurality of grooves includes a constant depth portion and a tapered depth portion. The position of the seal member relative to the constant and taped depth portions defines the first flow position, the second flow position and the varied intermediate flow positions.

In still another aspect, the position of the seal member relative to the constant depth portions defines the second flow position.

In a further aspect, the position of the seal member relative to the varied depth portion defines the varied intermediate flow positions.

In yet an additional aspect, a flow compensator is located within the first liquid passageway of the plunger.

In an additional aspect, the invention provides a dual flow fitting for controlling the amount of liquid being discharged through the fitting from a spout, the fitting comprising: a housing body having an axial bore extending there through from an inlet end to an outlet end, the housing body having a circumferentially extending inner surface defining at least part of the bore; a plunger located within the bore of the housing body, the plunger having an outer surface opposing the inner surface of the housing body, an outer liquid passageway defined between the outer surface and the inner surface and being in fluid communication with the inlet end and outlet end, the plunger further having an inner liquid passageway configured to permit liquid flow through the plunger; the plunger being moveably received within the bore and being moveable between a first flow position, a second flow position and a plurality of intermediate flow positions, the intermediate flow positions being located between the first and second flow positions; a seal member being supported by inner surface and engaged with the outer surface; in the first flow position the seal member being circumferentially engaged with the outer surface whereby liquid flow through the outer liquid passageway is prevented and liquid flow through the inner liquid passageway is not prevented; in the second flow position the seal member being disengaged from at least portions of the outer surface and defining with the outer surface a minimum flow restriction though the outer liquid passageway; and in the plurality of intermediate flow positions the seal member being disengaged from at least portions of the outer surface and respectively defining a plurality of varied flow restrictions in the outer liquid passageway, the plurality of varied flow restrictions being greater flow restrictions through the outer liquid passageway than the minimum flow restriction and each respectively permitting a different liquid flow through the outer liquid passageway.

In another aspect, defined in the outer surface are a plurality of spaced apart grooves, at least some of the grooves including a length of constant cross sectional area and a length of varied cross sectional area.

In a further aspect, the length of varied cross sectional area is located toward the outlet end of the housing body and the length of constant cross sectional area is located toward the inlet end of the housing body.

In an additional aspect, in the first flow position the seal member is engaged with the outer surface in a location adjacent to the length of varied cross sectional area.

In yet another aspect, in the plurality of intermediate flow positions the seal member is engaged with the outer surface along the length of varied cross sectional area.

In a still a further aspect, in the second flow position the seal member is engaged with the outer surface along the length of constant cross sectional area.

In an additional aspect, a flow compensator is provided in the inner liquid passageway.

In one aspect, the invention provides a method of flowing liquid through a dual flow fitting, the method comprising: defining a first liquid passageway through a plunger received within a housing body; defining a second liquid passage way between an outer radial surface of the plunger and an inner radial surface of the housing body; axially moving the plunger within the housing body to a first flow position closing the second liquid passageway to prevent liquid flow there through while permitting liquid to flow through the first liquid passageway; axially moving the plunger within the housing body to a second flow position opening the second liquid passageway and permitting liquid to flow through the second liquid passageway and through the first liquid passageway; and axially moving the plunger within the housing body through a plurality of intermediate flow positions between the first flow position and the second flow position causing a varied amount liquid to flow through the second liquid passageway while liquid also flows through the first liquid flow passageway.

In a further aspect, in the first flow position, flow through the fitting is at a lowest flow rate for the fitting.

In an additional aspect, in the second flow position, flow through the fitting is at a highest flow rate for the fitting.

In yet another aspect, in the plurality of intermediate flow positions, flow through the fitting varies between a lowest and highest flow rate for the fitting.

In still a further aspect, in the first flow position flow through the fitting is at a lowest flow rate for the fitting, in the second flow position flow through the fitting is at a highest flow rate for the fitting, and wherein in the plurality of intermediate flow positions flow through the fitting varies between the lowest flow and the highest flow through the fitting.

Accordingly, one aspect of the invention is a dual flow fitting for controlling the amount of liquid, namely water, being discharged through the fitting from a spout or arm of a faucet assembly, comprising: a housing body having an axial bore extending there through and defining an inlet end and a discharge end of the fitting, a plunger located within the bore of the housing body, the plunger and the housing body being moveable relative to one another between a low flow position and a high flow position; a seal member supported in a position along one of an inner surface housing body and an outer surface of the plunger; a plurality of grooves defined in the other of the inner surface and the outer surface, at least one of the grooves having a varying volume portion, this varying portion having a cross-sectional area that varies over a length of the groove; wherein as the plunger and housing body move relative to one another between the low flow position and the high flow position, the varying portion moves along the seal member and varies the high flow of liquid from the fitting.

In some embodiments, the high flow position includes a low- or minimum high flow position and a high- or maximum high flow position. In some embodiments, one part of the varying portion is located adjacent to the seal member in the minimum high flow position another part of the varying portion is located adjacent to the seal member in the maximum high flow position. In some embodiments, the outer surface is directly opposed to at least a portion of the inner surface. In some embodiments, the outer surface axially overlaps at least a portion of the inner surface. In some embodiments, the inner surface is a radial inner surface. In some embodiments, the outer surface is a radial outer surface. In some embodiments, the grooves extend axially. In some embodiments, the seal member is supported in a position along the inner surface and the grooves are defined in the outer surface. In some embodiments, the varying portion has a cross-section defining a V-shape. In some embodiments, the length of the varying portion is less than half a length defined by the grooves. In some embodiments, the cross-sectional area of the varying portion tapers toward an end of one of the housing body and plunger that is opposite of the attachment device.

According to another aspect of the invention, a fitting for controlling the amount of liquid passing through the fitting is provided and includes an attachment device or cap nut being connectable to a spout of the fitting; a housing body extending from the cap nut and having an axial bore extending there through; a plunger located within the bore of the housing body, the plunger and the housing body being moveable relative to one another between a low flow position and a high flow position; a seal member located within the bore between the housing body and the plunger; a plurality of grooves located opposite of the seal member and being defined in a surface of one of the housing body and the plunger, at least one of the grooves having a varying portion varying in cross-sectional area over a length of the groove; wherein as the plunger and housing body move relative to one another between the low flow position and the high flow position, the varying portion moves along the seal member and varies the high flow of liquid from the fitting.

According to another aspect, the high flow position includes a minimum high flow position and a maximum high flow position.

In a further aspect, one part of the varying volume portion is located toward the seal member in the minimum high flow position another part of this varying portion is located toward the seal member in the maximum high flow position.

In another aspect, the outer surface is directly opposed to at least a portion of the inner surface.

In yet another aspect, the outer surface axially overlaps at least a portion of the inner surface.

In a further aspect, the inner surface is a radial inner surface.

In still another aspect, the outer surface is a radial outer surface.

In an additional aspect, the grooves extend axially.

In yet a further aspect, the seal member is supported in a position along the inner surface and the grooves are defined in the outer surface.

In a further aspect, the varying portion has a cross-section defining a V-shape.

In an additional aspect, the length of the varying portion is less than half a length defined by the grooves.

In yet another aspect, the cross-sectional area of the varying portion tapers in a direction toward an end of one of the housing body.

In still a further aspect, the varying portion tapers toward the discharge end of the fitting.

In an additional aspect, the plunger defines a first liquid passageway through the fitting, the first liquid passageway being through a full length of the plunger.

In another aspect, a second liquid passageway is defined between the plunger and housing body.

In yet another aspect, the second liquid passageway is partially defined by the grooves.

In a further aspect, the fitting includes a pressure compensator.

In yet a further aspect, the pressure compensator is at least partially defined by the plunger.

In still a further aspect, a cap nut coupled to the housing body, the cap nut including threads for attachment to corresponding threads of a spout.

In another aspect, the plunger defines a first flow passageway through the length of the plunger, and wherein a second flow passageway is defined between the plunger and housing body, wherein the seal and the grooves cooperate to define a first restricted flow through the second flow passageway when the seal and the grooves are in a first relative position, wherein the seal and the grooves cooperate to define a second restricted flow through the second flow passageway when the seal and the grooves are in a second relative position, the second restricted flow being less than the first restricted flow.

Further objects, features and advantages of this invention will become readily apparent to persons skilled in the art after review of the following description with reference to the drawings and the claims that are appended to inform a part of this specification.

DETAILED DESCRIPTION

As used in the description that follows, directional terms such as "upstream" and "downstream" are used with reference to the orientation of the elements with respect to intended liquid flow through the device, as presented in the figures. Accordingly, "upstream" indicates a direction toward the inlet of liquid flow into the device and "downstream" indicates a direction toward the outlet of liquid flow from the device. The terms "inward" or "inner" and "outward" or "outer" indicate a direction that is generally toward or away from a central axis of the referred to part, whether or not such an axis is designated in the figures. An axial surface is therefore one that faces in the axial direction. In other words, an axial surface faces in a direction along the central axis. A radial surface therefore faces radially, generally away from or toward the central axis.

Figure 1:
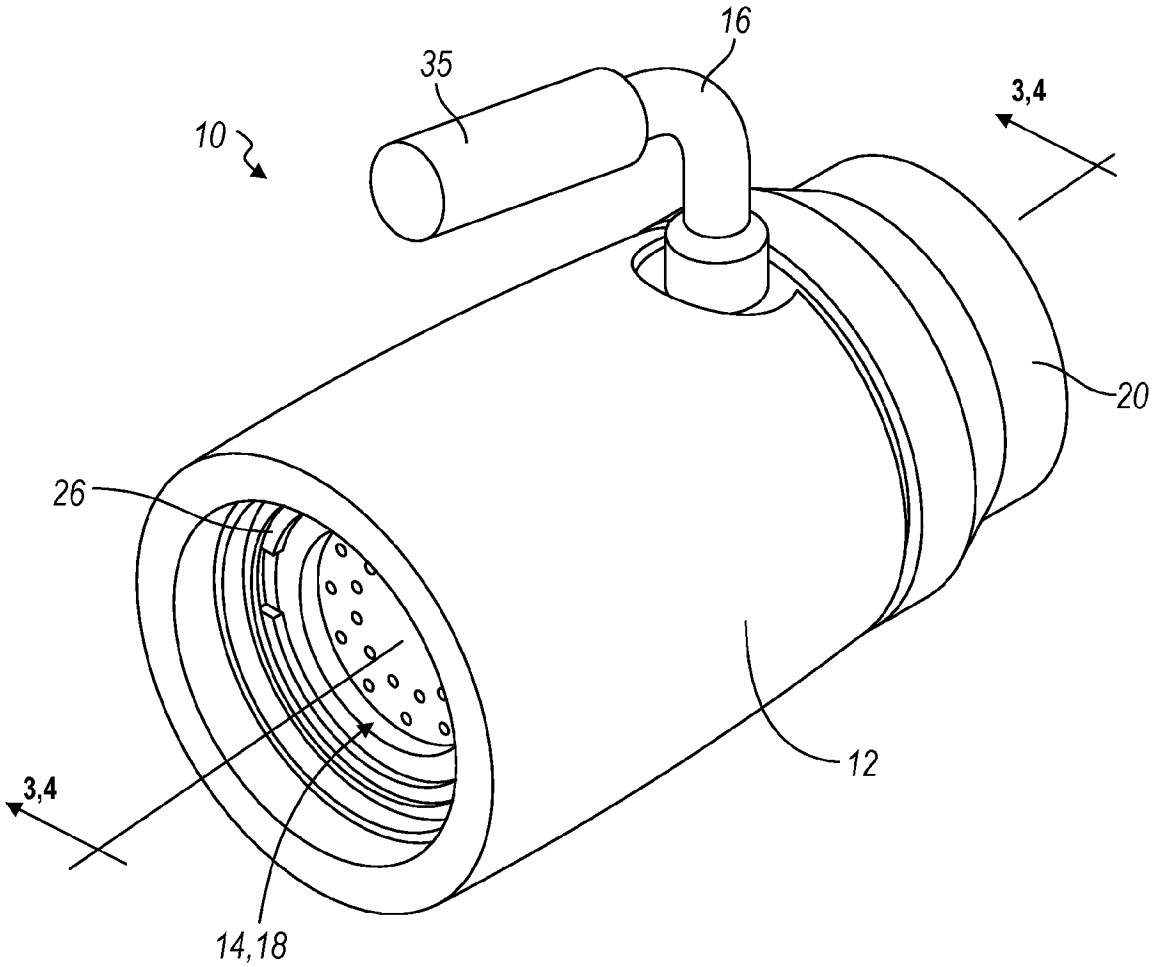
FIG. 1 is a perspective view of a dual flow fitting embodying the principles of the present invention.
Figure 2:
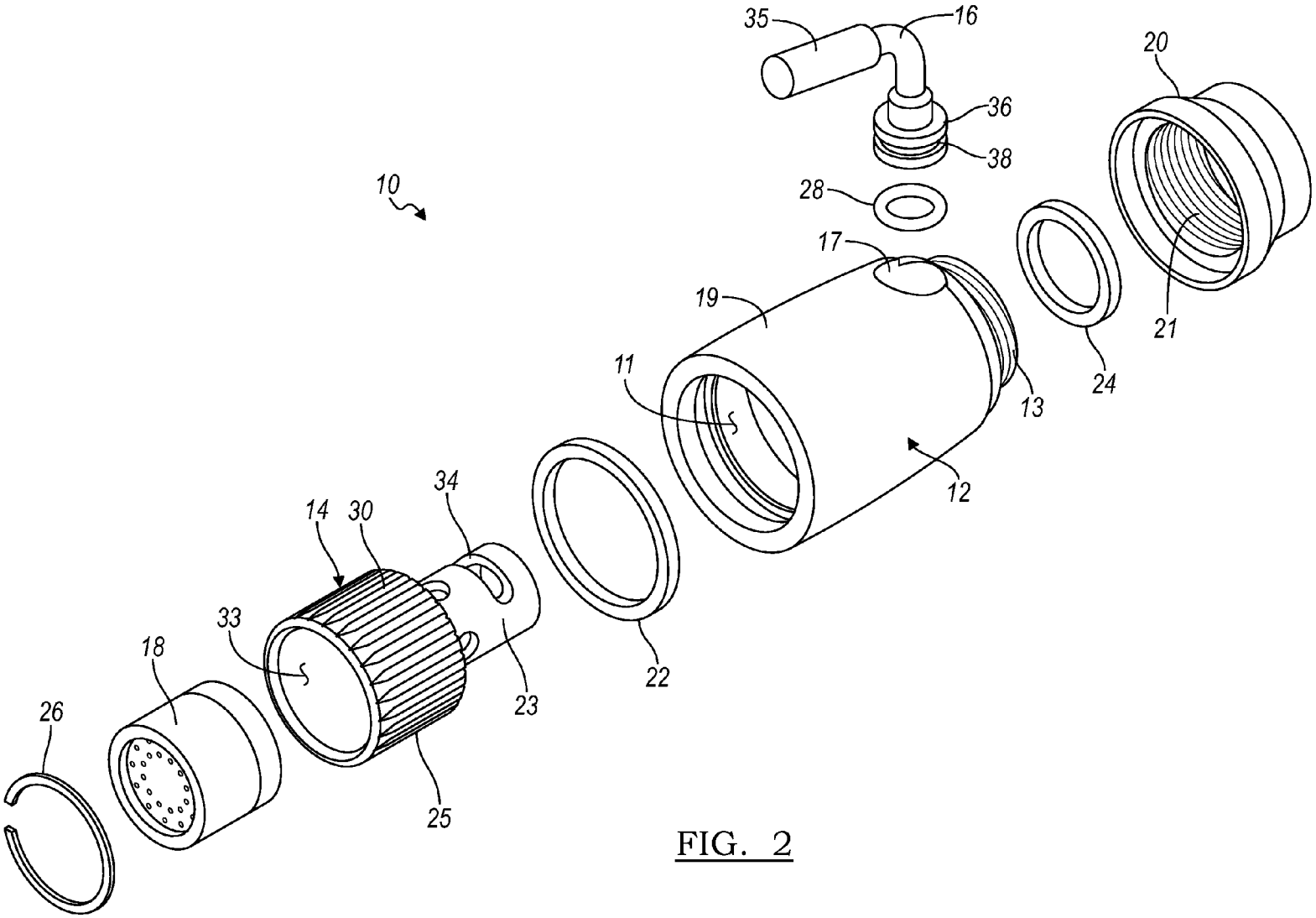
FIG. 2 is an exploded view of the fitting seen in FIG. 1.

Referring now to the drawings, a dual flow fitting embodying the principles of the present invention is generally illustrated in FIGS. 1 and 2 and designated at 10. As seen in FIG. 1, the fitting 10 is illustrated as a shower head. However, it will be readily appreciated that the principles of the present fitting can be embodied in a variety of faucets or spray heads. FIG. 1 shows a perspective view of the assembled fitting 10 and FIG. 2 shows an exploded view of the device 10 and depicts the various internal components. As seen in these figures, the fitting 10 includes as its principal components a housing body 12, a plunger 14, a lever 16, a pressure compensator 18, cap nut 20, and a seal 22.

Figure 3:
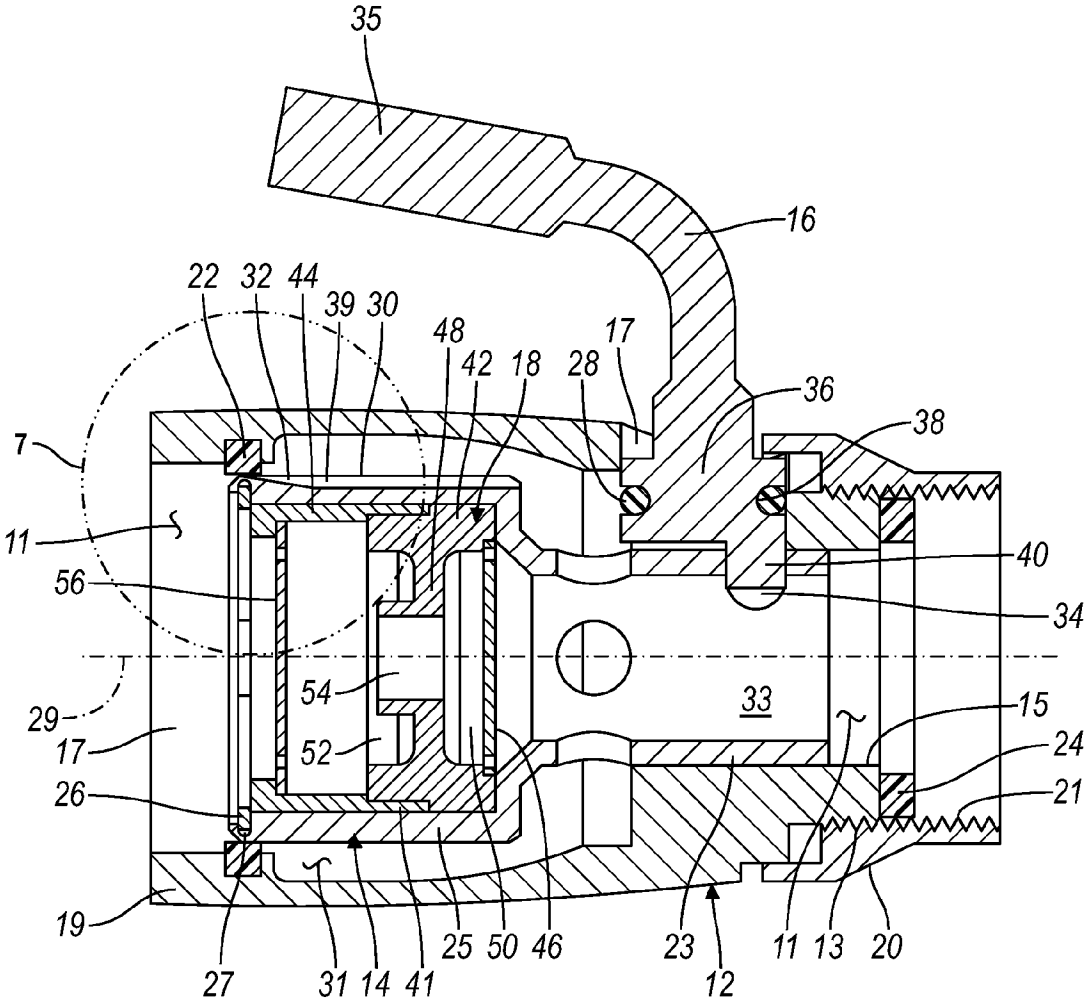
FIG. 3 is a cross-sectional view of the fitting, in a first or low flow position, generally taken along line 3-3 in FIG. 1.
Figure 4:
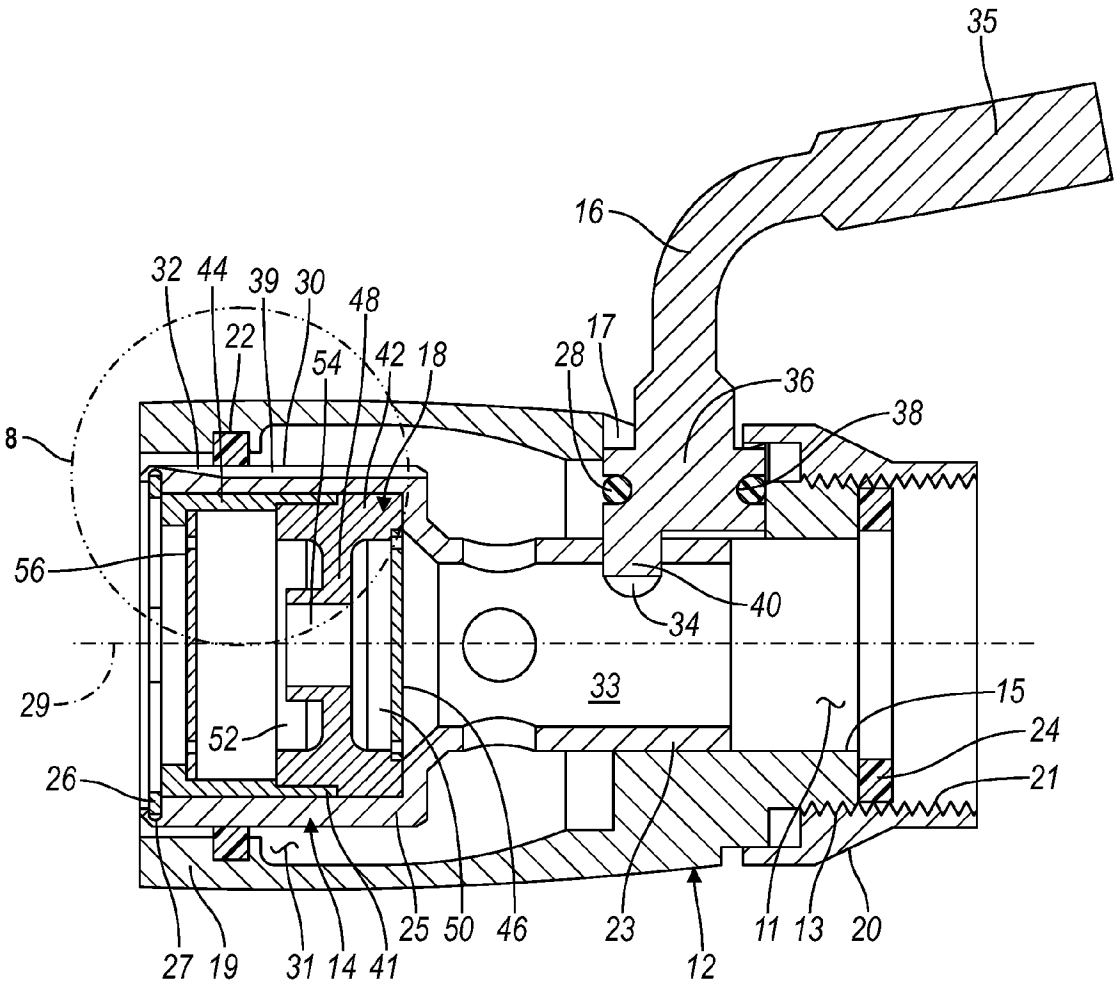
FIG. 4 is a cross-sectional view, similar to that of FIG. 3, but illustrating the fitting in a second or high flow position.

The cap nut 20 is configured to attach the fitting 10 to a spout or other liquid supply. As seen in FIGS. 2-4, the cap nut 20 is provided with internal threads 21 for female attachment to a spout (not shown) having external threads. The cap nut 20 may alternatively have external threads for male attachment to an internally threaded spout. The threads 21 of the cap nut 20 further couple it to the housing body 12 via male threads 13 provided on an end of the housing body 12 that screw into the bottom of the cap nut 20. The cap nut 20 accordingly acts as a retention mechanism for securing together the various components of the fitting 10.

A washer gasket 24 is positioned upstream of the housing body 12 and is seated inside the cap nut 20. The washer gasket 24 sits between the threads of the housing body 12 and the threads of the faucet when the assembled fitting 10 is installed on a faucet. When the fitting 10 is attached to a faucet, the washer gasket 24 seals water flow away from the mated threads of the cap nut 20 and housing body 12 and directs the flow into an axial bore in the housing body 12.

The housing body 12 defines a central bore 11 extending there through from a reduced diameter inlet 15, adjacent to the previously mentioned threads 13, to an outlet 17 at the bell-shaped opposing end 19.

The plunger 14 is coaxially received within the bore 11 of the housing body 12. As shown in FIG. 2, the plunger 14 includes a socket 25 from which extends, in the upstream direction, a reduced diameter shank 23. The socket 25 is further received within the enlarged bell-shaped end 19 of the housing body 12 and is spaced apart therefrom to define an outer passageway 31 between the two components. The shank 23 is further received within that portion of the bore 11 defining the reduced diameter inlet 15. Preferably, the outer diameter of the shank 23 closely approximates the inner diameter of the inlet 15 while allowing for some rotational and translational movement there between. As further discussed below, a plurality of grooves 30 are formed in the outer surface of the socket 25.

A seal member 22 is positioned within the axial bore of the housing body 12 between the inner surface of the housing body 12 and the outer surface of the plunger 14. The seal member 22 restricts flow of water through the passageway 31 when the fitting 10 is in a low flow position. This low flow position is further discussed below. Alternatively, grooves may be formed on the inside surface of the housing body 12, with the seal member 22 being supported by the plunger 14.

A bore or inner passageway 33 also extends through the plunger 14. Received within the bore 33 and the socket 25 of the plunger 14 is a pressure compensator 18. The pressure compensator 18 may be of any known construction, and for this reason is only generally, and illustratively, discussed herein. As seen in FIGS. 3 and 4, the pressure compensator 18 includes a two-part housing 41 including an upper (upstream) housing 42 and a lower (downstream) housing 44. The upper housing 42 retains a perforated plate 46, which may operate as a particulate filter. Additionally, the upper housing 42 includes a partition 48 dividing the upper housing 42 into upper and lower chambers, respectively designated at 50, 52, which are connected by flow passages (not shown) extending through the partition 48. A central opening 54 is also provided through the partition 48. Received in the central opening 51 is an elastomeric element (not shown). The elastomeric element operates with the upper housing 42 to provide a substantially uniform flow rate of water through the pressure compensator 18, regardless of the pressure at which the water is provided. By way of example, the elastomeric element may deflect upward and downward in response to the system pressure, the deflection altering the size of flow passages' orifices. The lower housing 44 includes a flow conditioner 56, which is illustrated as a perforated plate having a number of holes 36 arranged in a pattern. The flow conditioner 56 controls the shape of the water stream out of the pressure compensator 18. Alternatively, the pressure compensator 18 may be of an aerating or a non-aerating variety. Pressure compensation can be achieved, for example, by use of an elastomeric control element within the spray head. Pressure compensation of the above variety is described in U.S. Pat. No. 4,344,459, issued Aug. 17, 1982, entitled "Fitting employing elastomeric element," the entire contents of which are incorporated herein by reference.

A snap or retaining ring 26 is seated in a groove 27 of the housing body 12, downstream of the pressure compensator 18, to retain the pressure compensator 18 firmly in place.

As described above, it will be appreciated that whenever water is provided to the fitting 10, at least a low flow of water will be provided through the bore 33 of the plunger 14. Depending on the position of the plunger 14, as moved by the lever 16, a variable high flow of water may additionally be provided through the outer passageway 31 as well.

As further discussed below, the lever 16, via handle 35, is used to adjust the position of the plunger 14 relative to the housing body 12. The lever 16 extends through an opening 17 in the housing body 12 and includes a seat 36 sealingly engaged between the housing body 12 and the plunger 14. For this purpose, the seat 36 may include a seal 28, such as an O-ring, received in a circumferential groove 38 on the seat 36.

Extending inwardly off of the seat 36, of the lever 16 includes a pin 40 that is received within a recess 34 defined in the plunger 14. The pin 40 is offset from the center of the seat 36 and the rotational axis of the lever, such that as the lever 16 is rotated, the pin 40 moves about the rotational axis and causes axial translation of the plunger 14 within the housing body 12. As discussed in detail below, moving the plunger 14 between forward and back positions allows the fitting 10 to control the flow rate of water there through.

Figure 7:
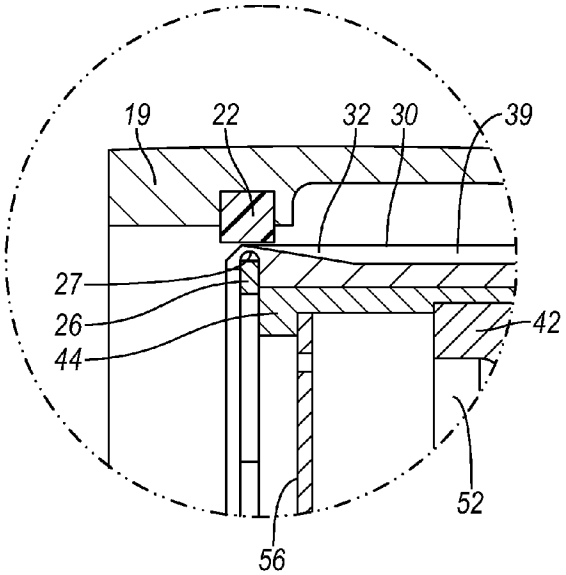
FIG. 7 is an enlarged view of a portion of the fitting, as encircled by line 7-7 in FIG. 3, in the low flow position.

Referring now to FIGS. 3 and 7, a cross-sectional view of the fitting 10, in a low flow position, is illustrated. As seen therein, the lever 16 is rotated such that the interaction between the pin 40 and the recess 34 positions the plunger 14 in a retracted or back position. In the back position, the distal end of the plunger 14 is in contact with the seal member 22 and obstructs the flow of water through the passageway 31 between the socket 25 and the body housing 12. In this position, flow through the device 10 only occurs through bore 33 of the plunger 14 and through the pressure compensator 18. For example, the low flow rate may be about 0.1 to about 1 gallons per minute, e.g., about 0.3 gallons per minute.

Figure 6:
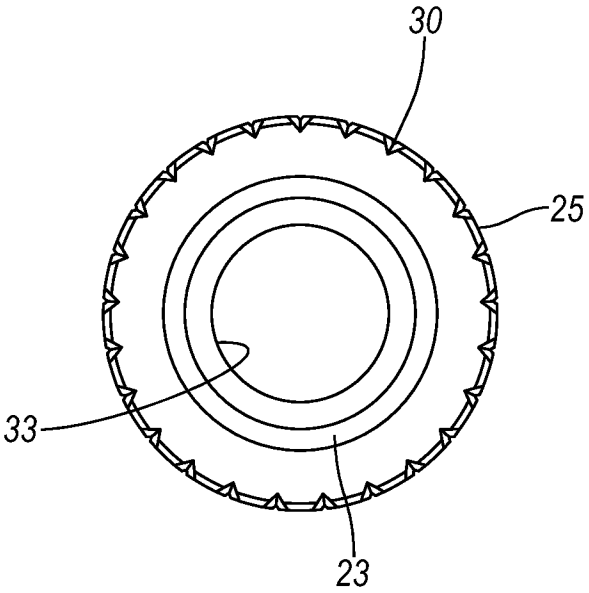
FIG. 6 is an end view of the plunger, generally taken along line 6-6 in FIG. 5.
Figure 5:
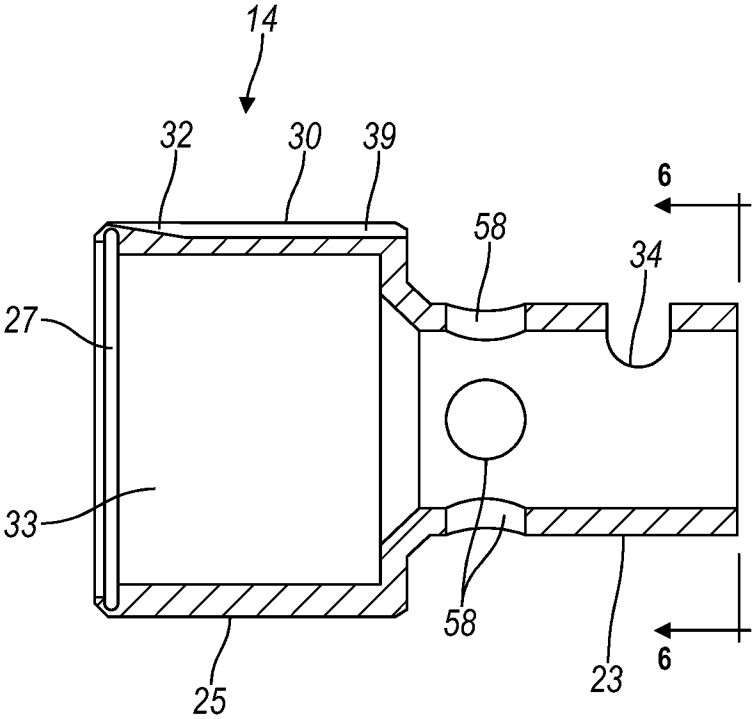
FIG. 5 is a cross-sectional view of a subcomponent, namely a plunger, of the fitting.

As mentioned above, a plurality of grooves 30 are axially provided in the outer surface of the plunger 18, and more particularly, the socket portion 25 of the plunger 18. The grooves 30 are formed parallel to one another and to the central axis 29. The grooves 30 further include a constant volume portion 39 and a varying volume portion 32, which are also respectively referred to herein as constant and varying portions. As seen in the figures, the constant portions 39 extend from the upstream end of the socket 25 over the majority of the length of the grooves 30. The varying portions 32 are provided over a lesser extent of the grooves 30 and are located adjacent to the distal, downstream end of the socket 25. These latter portions, the varying portions 32, taper from the constant volume portions 39, with a decreasing cross-sectional area, until terminating at or adjacent to the distal end of the socket 25. While the grooves 30 may have a variety of cross-sectional shapes, the illustrated cross-section shape is V-shaped. This is perhaps best seen in FIG. 6.

Figure 8:
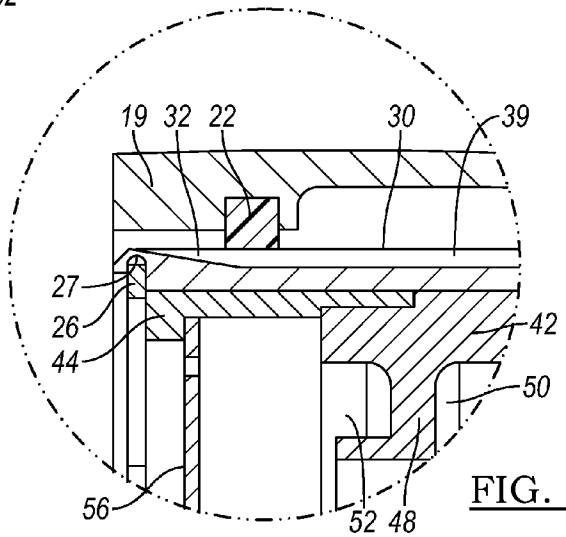
FIG. 8 is an enlarged view of a portion of the fitting, as encircled by line 8-8 in FIG. 4, in the high flow position.

Referring now to FIGS. 4 and 8, illustrated are cross-sectional views similar to those of FIGS. 3 and 7, but illustrating the fitting 10 in a maximum high flow position. With the lever 16 rotated 180 degrees, the interaction of the pin 40 and the recess 34 causes the plunger 14 to be translated in the downstream direction, in other words, forward. When the plunger 14 is in the forward position, the seal 22 no longer contacts the socket 25 in such a way that the passageway 31 is occluded. Rather, the seal 22 is caused to move along the grooves 30, in an upstream direction, to a position where the grooves 30 are open and provide a pathway past the seal 22. To allow the water flow to enter the passageway 31, a series of spaced apart radial openings 58 are formed through the shank 23 adjacent to the socket 25. Preferably, in the maximum high flow position, the seal 22 is moved relative to the grooves 30 such that the seal 22 is over the area of the constant volume portions 39 of the grooves 30. This results in a maximum amount of flow through the grooves and, therefore, through the passageway 31. It is noted that in this maximum high flow position, the flow of water also continues to also pass through the pressure compensator 18 and the bore 33 of the plunder 14. As a result, the flow through the fitting 10 will be its least restricted. This high flow rate may be about 1 to about 5 gallons per minute, e.g., about 2 gallons per minute.

Figure 9:
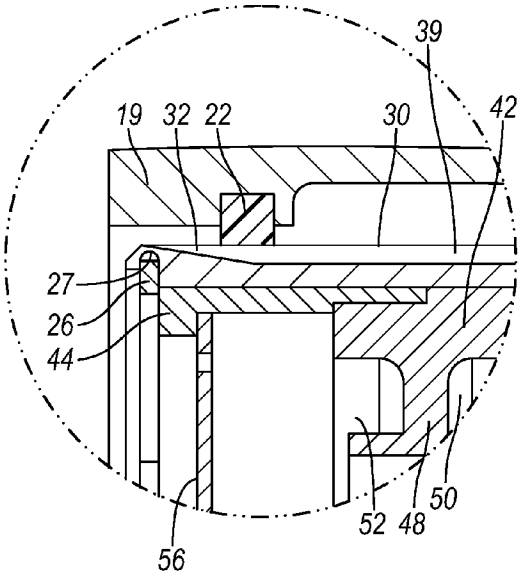
FIG. 9 is an enlarged view of a portion of the fitting, similar to the views of FIGS. 7 and 8, in a varied high flow position.

Additionally, the lever 16 can be turned to an infinite number of intermediate positions between the maximum high flow position and the minimum high flow position. One such position is illustrated in FIG. 9. In these intermediate positions, the seal member 22 is located at various positioned along the varying portions 32 of the grooves 30. Because the varying portions 32 of the grooves 30 are tapered from a relatively large cross-sectional area to a relatively small cross-sectional area, the flow rate through the passageway 31, the grooves 30 and the device 10, can be varied by varying the relative position of the seal 22 with respect to the varying portion 32 of the grooves 30, which, as will be appreciated, varies the amount of the restriction of the passageway 31. As the part of the varying portion 32 with the smaller cross sectional area moves away from the seal member 22 and the part of the varying portion 32 with the large cross-sectional area moves toward the seal member 22 and the flow rate increases. The intermediate flow rates may be varied between about 0.1 and about 5 gallons per minute (e.g. between about 0.3 and about 2 gallons per minute). Alternatively, or in conjunction with a continuous range of lever motion, the lever 16 may lock into specific intermediate positions.

As a person skilled in the art will really appreciate, the above description is meant as an illustration of at least one implementation of the principles of the present invention. This description is not intended to limit the scope or application of this invention since the invention is susceptible to modification, variation and change without departing from the spirit of this invention, as defined in the following claims.

I claim:

1. A dual flow fitting for controlling the amount of liquid being discharged through the fitting from a spout, the fitting comprising:

a housing body;

a plunger movably received within the housing body and being axially movably between a first flow position, a second flow position and a plurality of varied intermediate flow positions between the first and second flow positions;

a first liquid passageway defined through the plunger and having an inlet end and an outlet end;

a flow compensator located within the first liquid passageway of the plunger, the flow compensator including a plate having a plurality of perforations therethrough, the flow compensator being removably retained in the plunger through the outlet end of the first liquid passageway;

a second liquid passageway defined between the plunger and the housing body;

the first and second liquid passageways cooperating to define a composite liquid passageway;

in the first flow position, a portion of the plunger being sealingly engaged with a portion of housing body and closing off the second liquid passageway, whereby a first composite volumetric flow rate of liquid through the composite liquid passageway is defined by a first volumetric flow rate of liquid through the first liquid passageway;

in the second flow position, the portion of the plunger being sealingly disengaged with the portion of housing body and the second liquid passageway being fully open, whereby a second composite volumetric flow rate of liquid through the composite liquid passageway is defined by the first volumetric flow rate of liquid through the first liquid passageway plus a second volumetric flow rate of liquid through the second liquid passageway; and in the plurality of varied intermediate flow positions, the portion of the plunger cooperates with the portion of the housing to define a corresponding plurality of varied intermediate flow restrictions in the second liquid passageway respectively defining a plurality of varied volumetric flow rates, whereby a plurality of varied composite volumetric flow rates of liquid through the composite liquid passageway are respectively defined by the first volumetric flow rate of liquid through the first liquid passageway plus one of the plurality of varied volumetric flow rates through the plurality of varied intermediate flow restrictions in the second liquid passageway.

2. The fitting according to claim 1, further comprising a seal member supported on one of an inner radial surface of the housing body and an outer radial surface of the plunger, the outer radial surface opposing the inner radial surface.

3. The fitting according to claim 2, wherein the seal member is supported on the inner radial surface and wherein position of the seal member relative to the plunger defining the first flow position, the second flow position and the varied intermediate flow positions.

4. The fitting according to claim 1, wherein the portion of the plunger includes an outer radial surface and the portion of the housing body includes an inner radial surface, and wherein one of the outer radial surface and the inner radial surface includes a constant diameter portion adjacent to a varied diameter portion.

5. The fitting according to claim 4, wherein the other of the outer radial surface and the inner radial surface includes a seal member supported thereon and configured to engage the one of the outer radial surface and the inner radial surface in a region of the varied diameter portion, and wherein positions of the seal member relative to the constant and varied diameter portions defining the first flow position, the second flow position and the varied intermediate flow positions.

6. The fitting according to claim 1, wherein the portion of the plunger includes an outer radial surface and the portion of the housing body includes an inner radial surface, a plurality of grooves being defined in one of the outer radial surface and the inner radial surface and a seal member being supported by the other of the outer radial surface and the inner radial surface, the seal member being configured to engage the one of the outer radial surface and the inner radial surface in a region of the grooves.

7. The fitting according to claim 6, wherein at least one of the plurality of grooves includes a constant depth portion and a tapered depth portion, and wherein position of the seal member relative to the constant and tapered depth portions defining the first flow position, the second flow position and the varied intermediate flow positions.

8. The fitting according to claim 7, wherein the position of the seal member relative to the constant depth portions defining the second flow position.

9. The fitting according to claim 7, wherein the position of the seal member relative to the varied depth portion defining the varied intermediate flow positions.

10. A dual flow fitting for controlling the amount of liquid being discharged through the fitting from a spout, the fitting comprising:

a housing body having an axial bore extending therethrough from an inlet end to an outlet end, the housing body having a circumferentially extending inner surface defining at least part of the bore;

a plunger located within the bore of the housing body, the plunger having an outer surface opposing the inner surface of the housing body, an outer liquid passageway defined between the outer surface and the inner surface and being in fluid communication with the inlet end and outlet end, the plunger further having an inner liquid passageway configured to permit liquid flow through the plunger between an inlet end and an outlet end thereof;

a flow compensator located within the first liquid passageway of the plunger, the flow compensator including a plate having a plurality of perforations therethrough, the flow compensator being removably retained in the plunger through the outlet end of the first liquid passageway;

the plunger being moveably received within the bore and being moveable between a first flow position, a second flow position and a plurality of intermediate flow positions, the intermediate flow positions being located between the first and second flow positions;

a seal member being supported by the inner surface and engaged with the outer surface;

in the first flow position the seal member being circumferentially engaged with the outer surface whereby liquid flow through the outer liquid passageway is prevented and liquid flow through the inner liquid passageway is not prevented;

in the second flow position the seal member being disengaged from at least portions of the outer surface and defining with the outer surface a minimum flow restriction though the outer liquid passageway; and in the plurality of intermediate flow positions the seal member being disengaged from at least portions of the outer surface and respectively defining a plurality of varied flow restrictions in the outer liquid passageway, the plurality of varied flow restrictions being greater flow restrictions through the outer liquid passageway than the minimum flow restriction and each respectively permitting a different liquid flow through the outer liquid passageway.

11. The fitting according to claim 10, wherein defined in the outer surface are a plurality of spaced apart grooves, at least some of the grooves including a length of constant cross sectional area and a length of varied cross sectional area.

12. The fitting according to claim 11, wherein the length of varied cross sectional area is located toward the outlet end of the housing body and the length of constant cross sectional area is located toward the inlet end of the housing body.

13. The fitting according to claim 12, wherein in the first flow position the seal member is engaged with the outer surface in a location adjacent to the length of varied cross sectional area.

14. The fitting according to claim 12, wherein in the plurality of intermediate flow positions the seal member is engaged with the outer surface along the length of varied cross sectional area.

15. The fitting according to claim 12, wherein in the second flow position the seal member is engaged with the outer surface along the length of constant cross sectional area.

* * * * *